US007387681B2

(12) United States Patent
Matsunaga et al.

(10) Patent No.: US 7,387,681 B2
(45) Date of Patent: Jun. 17, 2008

(54) LIQUID DISPENSING METHOD AND APPARATUS

(75) Inventors: Masafumi Matsunaga, Tokyo (JP); Takayuki Aoyagi, Tokyo (JP); Kouki Terao, Tokyo (JP)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/509,344

(22) PCT Filed: Mar. 27, 2003

(86) PCT No.: PCT/JP03/03861

§ 371 (c)(1),
(2), (4) Date: Sep. 28, 2004

(87) PCT Pub. No.: WO03/082480

PCT Pub. Date: Oct. 9, 2003

(65) Prior Publication Data

US 2005/0150449 A1 Jul. 14, 2005

(30) Foreign Application Priority Data

Mar. 29, 2002 (JP) ..... 2002-095922

(51) Int. Cl.

| | |
|---|---|
| ***B05C 5/00*** | (2006.01) |
| ***B05C 11/00*** | (2006.01) |
| ***B05B 1/16*** | (2006.01) |
| ***B65B 1/04*** | (2006.01) |
| ***B67D 5/60*** | (2006.01) |

(52) U.S. Cl. ..... 118/300; 118/692; 239/76; 141/67; 141/104; 222/145.1; 222/389

(58) Field of Classification Search ..... 118/300, 118/313, 384, 692–694; 222/145.1, 389, 222/135, 145.5, 334, 145.6, 398, 386.5; 239/76; 141/9, 67, 95, 192, 100, 104, 2, 8
See application file for complete search history.

(56) References Cited

U.S. PATENT DOCUMENTS

| | | | | |
|---|---|---|---|---|
| 2,545,445 A | | 3/1951 | Chatterton | 91/56 |
| 3,892,389 A | * | 7/1975 | Contastin | 366/138 |
| 4,911,956 A | * | 3/1990 | Gabryszewski et al. | 427/424 |

(Continued)

FOREIGN PATENT DOCUMENTS

| | | |
|---|---|---|
| JP | 60005251 | 1/1985 |

(Continued)

*Primary Examiner*—Yewebdar T Tadesse
(74) *Attorney, Agent, or Firm*—Wood, Herron & Evans LLP

(57) ABSTRACT

A method of dispensing a liquid, which handles a minimum amount of liquid without wasting it and to dispense and spray an exact amount of the liquid without precipitating solid particles. The method including the steps of regulating a flow rate of liquid in a flow passage by orifices 8-1, 8-2 while letting the liquid flow through flow passages 10-1 and 10-2 between syringes 5-1 and 5-2 by applying a pressure of 0.001 MPa to 10 MPa to liquid 6 including solid particles and filled in one syringe vessel 5-1 and by setting a pressure of liquid in the other syringe 5-2 at a lower level than the pressure of liquid in the syringe 5-1 and dispensing the liquid from the flow passage by an auto dispensing valve 1.

10 Claims, 4 Drawing Sheets

U.S. PATENT DOCUMENTS 5,435,462 A * 7/1995 Fujii ..... 222/82
5,819,983 A * 10/1998 White et al. ..... 222/1
5,857,589 A * 1/1999 Cline et al. ..... 222/1
6,386,396 B1 * 5/2002 Strecker ..... 222/261
6,540,104 B1 * 4/2003 Yanagita et al. ..... 222/1
6,672,519 B2 * 1/2004 Hunter et al. ..... 239/290

FOREIGN PATENT DOCUMENTS

JP 63119877 5/1988

* cited by examiner

LIQUID DISPENSING METHOD AND APPARATUS

TECHNICAL FIELD

The present invention relates to a method and apparatus for dispensing a liquid such as an adhesive or a coating material including solid particles.

BACKGROUND ART

Heretofore, a liquid such as a coating material including solid particles has been handled and dispensed from a dispensing valve by the following three methods because the solid particles easily precipitate. Note that, the expression "dispensing a liquid" as used herein comprehends both dispensing (dispensing the liquid as it is) and spraying (spraying the liquid, that is, atomizing it and then dispensing it).

(1) A method in which a liquid stirred by a large-sized apparatus in a storage tank is divided and stored in syringes or small vessels and used right away.

(2) A method as proposed by JP 63-119877 A, in which a liquid in one of two pressure vessels is pressurized with compressed air, the air of the other vessel is opened to move the liquid through a liquid flow passage between the two vessels, and an auto dispensing valve as a dispensing valve is provided at an intermediate portion of the flow passage to dispense the liquid while the liquid is moving. This operation is carried out alternately between the vessels to prevent the precipitation of the solid particles.

(3) A method in which a circulation circuit is formed from, for example, a pump dispensing port to an auto dispensing valve and a pump suction port by using a pump or the like to circulate a liquid forcedly to a portion near the needle and valve seat of the auto dispensing valve. For example, a dispersion (dispersion type liquid including solid particles) of a mixture of carbon particles and a binder solution which is spray coated on the inner surface of an alkali dry battery to improve its performance is circulated at a relatively high liquid pressure in order to re-disperse secondary agglomerates of the particles. Since stable coating can be performed by employing this method while preventing the precipitation of the carbon particles, it is globally used.

However, in the method mentioned in the above item (1), in the case of a liquid having a low viscosity in the range of 3,000 mPa·s or less, particularly about 1 to 500 mPa·s, the precipitation of the solid particles, although depending on the specific gravity and size of the particles, is so fast that there is a big difference between the quality of the liquid at the start of dispensation and the quality of the liquid during dispensation or at the end of dispensation, and particularly the content of the particles is the major concern. Further, the precipitated particles accumulate on a portion near the valve and the valve seat of the auto-dispensing valve, often causing a dispensation failure.

In the method mentioned in the above item (2), the flow rate of the liquid is determined by the level of air pressure. Therefore, control of a period of time before the subsequent step, that is, from the time when the liquid moves from the first tank to the second tank to the time when the liquid moves from the second tank to the first tank is affected only by the pressure of compressed air. Therefore, when a commercially available air regulator is used, a low-viscosity liquid filled in a syringe having a small capacity of about $5\times10^{-6}$ $m^3$ to $30\times10^{-6}$ $m^3$ (5 cc to 30 cc) for instance, is moved to a syringe on the opposite side instantaneously, in less than 1 second when pressurized at a pressure of 0.05 MPa which is the minimum graduation.

Thereby, problems arise that the operation of dispensing the liquid by the dispensing valve cannot be continued for a desired period of time and dispensation cannot be carried out stably. The method also involves problems such as the inclusion of air and the difficulty of dispensing a predetermined amount of the liquid stably.

Further, even if an air regulator equipped with a gauge having a minimum graduation of 0.001 MPa is used to apply pressure to the liquid, the moving time of the liquid in the syringe having a capacity of $30\times10^{-6}$ $m^3$ (30 cc) is in the order of second and the moving direction must be changed frequently to carry out an automatic operation. Also, the frequent interruption of work cannot be avoided even when a large vessel having a capacity of several liters is used.

Thus, to prevent the interruption of work at the time of changing of the moving direction, as proposed in JP 60-5251 A, there is a method in which three coating material tanks are used for the stable supply of a powder slurry coating material. In this method, pressurized air is supplied to the first tank to always maintain a fixed pressure, and the powder slurry coating material is pumped to the third tank through a coating gun at the same liquid pressure as the pressure of the pressurized air. When the level of the first tank lowers, pressurized air is supplied to the second tank to pump the coating material through the second tank and dispense it from the coating gun. In this method, while pumping from the second tank is being stabilized, 10 seconds of simultaneous pumping from the first and second tanks is required.

In general, these tanks have a capacity of $18\times10^{-3}$ $m^3$ to $30\times10^{-3}$ $m^3$ (18 liters to 30 liters). Therefore, this method is not suitable for the above-mentioned syringes, which are small vessels.

Further, the above-mentioned two methods disclosed by JP 63-119877 A and JP 60-5251 A involve a problem that a coating film adhered to the wall of a tank is dried upon its contact with a dry gas as the level of the coating material lowers because a pressure source is a gas such as compressed air. Since the powder slurry and the dispersion contain a solution of a polymer such as a binder in addition to inorganic or organic solid particles, after they are dried, the polymer solution component which has not been re-dissolved is no better than a foreign matter.

Furthermore, it is known in the industry that when compressed gas such as compressed air comes into contact with a low-viscosity liquid rich with a solvent in particular, a part of the gas dissolves in the liquid. Therefore, a quality problem often occurs because micro-bubbles are contained in the dispensed liquid.

In the method mentioned in the above item (3), a special plunger pump which is free from pulses and the accumulation or agglomeration of particles in the circuit and which is not worn down by solid particles must be used. This apparatus is large in size and expensive and also requires one (1) gallon (about $3.8\times10^{-3}$ $m^3$ (3.8 liters)) or more of a coating material for stable circulation. Therefore, it is not suitable as a tester for testing with several $10\times10^{-6}$ $m^3$ (several tens of cc) of a coating material which is required for the laboratory-level development of a material, and a huge amount of money has been spent on the development of a material. In addition, a large amount of a solvent has been required for the cleaning of the inside of the circuit at the end of work and most of the coating material in the circuit cannot be used because it contains a cleaning solvent.

In the past several years, the number of expensive materials has been growing due to progress in the development of functional coating materials. Such materials include a dispersion containing inorganic particles having a uniform particle size distribution and a size of several micrometers or less, or of a nanometric level in some cases, a powder slurry containing polymer particles uniform in particle size, an electrode-ink for the electrodes of fuel cells as proposed in U.S. Pat. No. 5,415,888 B and the like, and an electrode-ink having super fine particles of platinum in a nanometric order carried on a carbon nanotube. Some of those coating materials not uncommmonly cost several million yen per kilogram, and an apparatus and method, which not only allow for high-quality coating but also are capable of making the most of a minimum amount of a coating material, are desired.

DISCLOSURE OF THE INVENTION

The present invention has been made in view of the above-mentioned problems, and an object thereof is to provide a method and apparatus for dispensing a liquid, which make it possible to handle a minimum amount of a liquid without wasting it and to dispense and spray an exact amount of the liquid without precipitating solid particles.

To solve the above-mentioned problems, the present invention provides the following method and apparatus for dispensing a liquid.

That is, the above-mentioned object has been achieved by providing: a liquid dispensing method including the steps of regulating a flow rate of liquid in a flow passage by flow rate regulating means while letting the liquid flow through the flow passage between two or more vessels by applying a pressure of 0.001 MPa to 10 MPa to the liquid including solid particles and filled in at least one vessel of the two or more vessels and by setting a pressure of liquid in at least one remaining vessel at a lower level than the pressure of liquid in the at least one vessel, and dispensing the liquid from the flow passage by a valve; and an apparatus for carrying out the method.

BEST MODE FOR CARRYING OUT THE INVENTION

Preferred embodiments of the present invention will be described hereinbelow with reference to the accompanying drawings.

Figure 1:
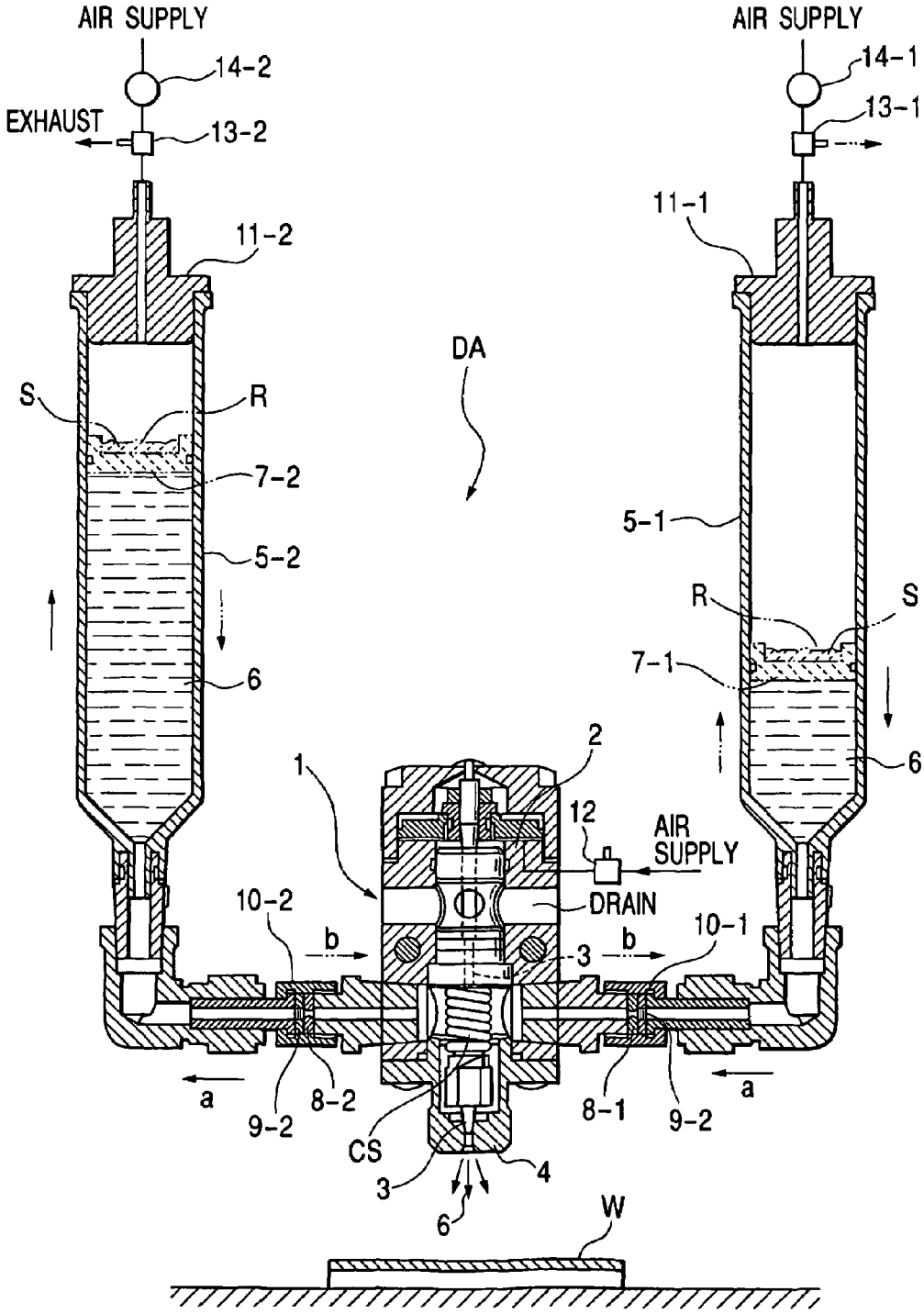
FIG. 1 is a longitudinal sectional view of a liquid dispensing apparatus according to a first embodiment of the present invention used in a method of dispensing a liquid according to the present invention.

FIG. 1 shows a liquid dispensing apparatus DA according to a first embodiment of the present invention used in a liquid dispensing method according to the present invention. In FIG. 1, reference numeral 1 denotes an auto-dispensing valve as a liquid dispensing valve. The auto-dispensing valve 1 is connected to syringes denoted by reference numerals 5-1 and 5-2 serving as vessels by connecting pipes 10-1 and 10-2 as liquid flow passages. The syringes 5-1 and 5-2 are filled with a liquid including solid particles denoted by reference numeral 6 (for example, solid particles having a particle diameter of a nanometric level to several hundreds of microns, preferably a nanometric level to several tens of microns are used).

Adaptors (lids) 11-1 and 11-2 are attached to the upper ends of the syringes 5-1 and 5-2 to seal them and are connected to the feed pipes of compressed air as a compressed gas from air supplies, and the compressed air feed pipes are provided with regulators with relief 14-1 and 14-2 and three-way solenoid valves 13-1 and 13-2, respectively, in order of mention from the upstream thereof. Owing to this constitution, compressed air is supplied into the syringe 5-1 through the three-way solenoid valve 13-1 while its-pressure is maintained at a predetermined pressure by the regulator with relief 14-1 to apply pressure to the liquid 6 filled in the syringe 5-1 and pump it to the syringe 5-2 through pipes 10-1 and 10-2 serving as flow passages by pressure. At this point, the syringe 5-2 is opened to the atmosphere by the three-way solenoid valve 13-2 to exhaust air in a space above the liquid.

The pressure in the syringe 5-2 may be set to a desired pressure lower than the compressed air in the syringe 5-1 by the regulator with relief 14-2 to produce a pressure difference so that the liquid can move.

As for movement, that is, inflow and outflow of the liquid from one vessel to the other, since a smooth flow can be formed when the liquid flows out and prevention of the precipitation of solid particles by a jet stream can be expected more as the pressure difference increases when the liquid flows in, it is preferred that the liquid flows out and flows in from the bottoms of the vessels, that is, from the bottoms of the syringes 5-1 and 5-2 as in this embodiment.

Orifices 8-1 and 8-2 serving as flow rate restricting members which are one of the flow rate regulating means are provided between the auto-dispensing valve 1 and the syringes 5-1 and 5-2. The diameters and lengths of the orifices 8-1 and 8-2 are not particularly limited but may be changed according to the viscosity and liquid pressure of the liquid or the diameter of the solid particles. In the case of a liquid having a viscosity of 3,000 mPa·s or less and including solid particles which precipitate relatively quickly, the orifices preferably have a diameter of 0.1 to 0.8 mm and a length of 0.5 to 10 mm, thereby making it possible to control the moving time of $30\times10^{-6}$ $m^3$ (30 cc) of the liquid having a viscosity of 100 mPa·s and a faster precipitation speed at a liquid pressure of 0.01 MPa in the range of 1 to 10 minutes.

The flow rate restricting members are not limited to a particular shape and may be needle valves whose openings can be adjusted. It is also possible to use processed injection needles having a small diameter, or annealed stainless steel tubes having a desired length and an inner diameter of, for example, 1.59 mm (1/16 inch). Further, after the flow rate restricting members divide the flow into a plurality of narrow paths, the divided flows may be impinged with one another and used in conjunction with means for dispersing agglomerates of solid particles to carry out excellent impingement dispersion.

At the upstreams of the orifices 8-1 and 8-2 serving as flow rate restricting members, screens 9-1 and 9-2 serving as filters are provided. The screens 9-1 and 9-2 are used to prevent dry foreign matter, which has adhered to the walls of the syringes serving as the vessels and fallen off from the wall, from flowing down. That is, the foreign matter is prevented from blocking the orifices 8-1 and 8-2 serving as flow rate restricting members and from mixing into the dispensed liquid.

In the liquid dispensing apparatus DA constituted as described above, foreign matter is removed from the liquid including the solid particles by the screens 9-1 and 9-2 in the pipes 10-1 and 10-2 serving as flow passages from the syringe 5-1 to the syringe 5-2, and the liquid is pumped in a direction shown by solid line arrows "a" in FIG. 1 in the above-mentioned predetermined moving time of 1 to 10 minutes while the flow rate of the liquid is regulated, to the above-mentioned predetermined value by the orifices 8-1 and 8-2. Pressurized air is supplied from an air supply to a piston 2 connected to a needle 3 of the auto-dispensing valve 1 attached between the pipes 10-1 and 10-2 through a three-way solenoid valve 12 to lift up the needle 3 against the pressure force of a spring CS. A clearance is formed between the needle 3 and a valve seat 4, and the liquid including solid particles is thereby dispensed from an opening in the valve seat 4. When the liquid level of the syringe 5-1 lowers and reaches a low level or the liquid level of the syringe 5-2 reaches a high level, the supply of compressed air by the three-way solenoid valve 13-1 attached to the upper adaptor 11-1 of the syringe 5-1 is cut off, and compressed air begins to be supplied through the three-way solenoid valve 13-2 attached to the upper adaptor 11-2 of the syringe 5-2 while it is maintained at a predetermined pressure by the regulator with relief 14-2. As a result, the liquid 6 in the syringe 5-2 is pressurized and pumped in a direction shown by double-dotted line arrows "b" in FIG. 1 in the pipes 10-2 and 10-1 serving as flow passages to flow into the syringe 5-1. At this point, the syringe 5-1 is opened to the atmosphere by the three-way solenoid valve 13-1 to exhaust air in the space above the liquid. When the liquid level of the syringe 5-2 lowers or reaches a low level or the liquid level of the syringe 5-1 reaches a high level, the flowing direction of the liquid is switched alternately between the syringes 5-1 and 5-2 in the same manner as described above to carry out dispensing operation continuously.

Thus, in the embodiment shown in FIG. 1, since the liquid including solid particles is pumped in the flow passages 10-1 and 10-2 as described above, the precipitation of the solid particles is prevented and the flow rate of the liquid is regulated by the function of the orifices 8-1 and 8-2 to make the liquid flow through the flow passages at a predetermined velocity. Therefore, a liquid having high quality and uniform dispersibility of the particles is dispensed by the auto-dispensing valve 1 for a desired period of time. Thus, smooth continuous operation is carried out. Therefore, when the syringes 5-1 and 5-2 are vessels having a small capacity of about $5\times10^{-6}$ $m^3$ to $30\times10^{-6}$ $m^3$ (5 to 30 cc) for instance, and an expensive liquid is filled into the syringes to be dispensed, this method is particularly useful because a minimum and exact amount of the liquid can be dispensed without wasting it.

Note that, in the embodiment shown in FIG. 1, the vessels are shown as syringes 5-1 and 5-2. However, in the present invention, the shape and size of the vessels are not particularly limited. When the vessels are used at a low pressure, commercially available inexpensive plastic syringes as shown in the above-mentioned embodiment having a capacity of $5\times10^{-6}$ $m^3$ to several $100\times10^{-6}$ $m^3$ (5 to several hundred cc) may be used. Also, commercially available inexpensive pots having a capacity of about $1\times10^{-3}$ $m^3$ (several liters) may be used. When a relatively high liquid pressure is desired, a three-piece structure consisting of a pressure resistant hollow metal cylinder or tube as a barrel portion, an upper portion and a bottom portion may also be used.

In the present invention, the flow rate regulating means can be used to move the liquid intermittently (discontinuously). That is, as shown in FIG. 1, compressed air supplies connected to the adaptors 11-1 and 11-2 of the syringes 5-1 and 5-2 are opened and closed intermittently (discontinuously) by the three-way solenoid valves 13-1 and 13-2 to apply pressure to the liquid intermittently so as to move it regularly with regular pulses. Note that, the liquid may be dispensed from the dispensing valve 1 while a stable liquid pressure between pulses is being maintained.

Also, in the present invention, as shown by chain lines in FIG. 1, plungers denoted by reference numerals 7-1 and 7-2 may be installed between the liquid 6 in the syringes and the compressed gas. The plungers 7-1 and 7-2 can prevent the dissolution of the gas in the liquid because they separate the liquid from the compressed gas. In addition, the plungers 7-1 and 7-2 may have the same diameter as the inner diameter of the syringes 5-1 and 5-2 to achieve the same pressure as the compressed gas. The ratio of the liquid pressure can be changed by varying the diameter of unshown cylinders using pistons connected to the plungers 7-1 and 7-2. The ratio of the sectional area of each of the plungers 7-1 and 7-2 to the sectional area of each of the cylinders or the pistons is called "pump ratio" in the industry. When the cylinders are smaller than the plungers 7-1 and 7-2, the liquid pressure becomes lower than the pressure of the compressed gas and when the cylinders are larger than the plungers 7-1 and 7-2, the liquid pressure becomes higher than the pressure of the compressed gas.

That is, in the present invention, by setting the ratio to 1/10, a liquid pressure of 0.001 MPa can be easily obtained with a compressed gas pressure of 0.01 MPa and by setting the ratio to 20, a liquid pressure of 10 MPa can be obtained at a normal compressor air pressure of 0.5 MPa in a production plant. For example, the low pressure in the former case is suitable for double-fluid spray whereas the relatively high liquid pressure of up to about 10 MPa in the latter case is suitable for airless spray.

In the present invention, as proposed in JP 2-111478 A, a pressure device having a pump ratio of 20 may be used to apply a liquid pressure of 10 MPa, for instance, so as to bring a liquefied carbonic acid gas into a super critical state so that the gas is mixed with a high-viscosity liquid to obtain a low-viscosity fluid. Even in the case of a low-viscosity liquid, it can be mixed with a liquefied carbonic acid gas which has been brought into a super critical state and sprayed to form a dry film, by making use of the property of the liquid that it volatilizes instantaneously when it is sprayed. In the present invention, the pressure and temperature of the carbonic acid gas are not particularly limited as far as it is in a range where it does not depart from the super critical state. For example, the gas can move the fluid while maintaining a differential pressure of about 10 MPa and a temperature of about 50° C.

Further, in the present invention, the liquid can be moved in accordance with an electric plunger type volumetric method by combining a plunger with a servo motor or stepping motor instead of using the compressed gas. In this method, there is a merit in that even a material whose viscosity increases with the elapse of time like a reactive type liquid, in particular, can be moved in a predetermined amount of the material per unit time and can be dispensed in a predetermined amount of the material.

Still further, in the present invention, the amount of the liquid equal to the amount dispensed by the auto-dispensing valve 1 can be supplied automatically or regularly into the vessel or circuit by an unshown separate liquid feeder at a higher pressure.

Furthermore, in the present invention, the liquid can be dispensed while it is moved. In the case of a liquid having no quality problem and a not so high precipitation speed, an unshown on-off valve provided among a vessel pressurized by once stopping the movement of the liquid in the flow passages 10-1 and 10-2 for a desired period of time, for example, another vessel at a downstream of the syringe 5-1 in FIG. 1 and, for example, a portion of the connection position with the pipe at the lower end of the syringe 5-2, that is, at an upstream of the syringe 5-2 may be closed to dispense the liquid. While the movement of the liquid in the flow passages 10-1 and 10-2 is once suspended by making the pressures of the two or more connected vessels the same, the liquid can be dispensed from the auto dispensing valve 1.

In addition, in the present invention, a solvent may be mixed into the compressed gas to prevent a liquid film adhered to the inner walls of the vessels from being dried, and as shown by chain lines in FIG. 1, a solvent S may be collected in depressions R formed on the gas side of the plungers 7-1 and 7-2 to create a solvent saturated atmosphere.

In the present invention, the liquid dispensed from the auto-dispensing valve 1 may be filled into other small-sized vessels etc., alone or as a filler. It may also be applied to an object to be coated and its form is not particularly limited.

Further, in the present invention, the liquid can be sprayed by attaching a spray nozzle to the distal end of the auto-dispensing valve 1. The sprayed liquid particles may be used for granulation, for instance, or may be applied to an object to be coated.

Still further, the liquid may be atomized by using the energy of the compressed gas to obtain a double-fluid spray.

Furthermore, in the present invention, the liquid can be sprayed intermittently (discontinuously) at a rate of 30 to 3,600 pulses per minutes or higher if conditions are met in order to maintain the amount of the liquid dispensed per unit time accurately. This operation can be easily carried out by activating the piston 2 intermittently by opening and closing the three-way solenoid valve 12 for compressed air, which is connected to the auto dispensing valve 1, intermittently with an unshown controller or the like. It has been generally impossible to continuously spray the liquid including solid particles at an extremely low flow rate of about $1\times10^{-6}$ $m^3$ to $10\times10^{-6}$ $m^3$/minute (about 1 cc to 10 cc/min) because the space between the nozzle or the needle 3 and the valve seat 4 could not be made small due to occlusion by agglomerates of the solid particles. By combining the method shown in JP-A 61-161175 proposed by the inventors of the present invention with the present invention, the dispersion state of the solid particles can be stabilized at any time, thereby making it possible to perform high-quality spray.

Figure 2:
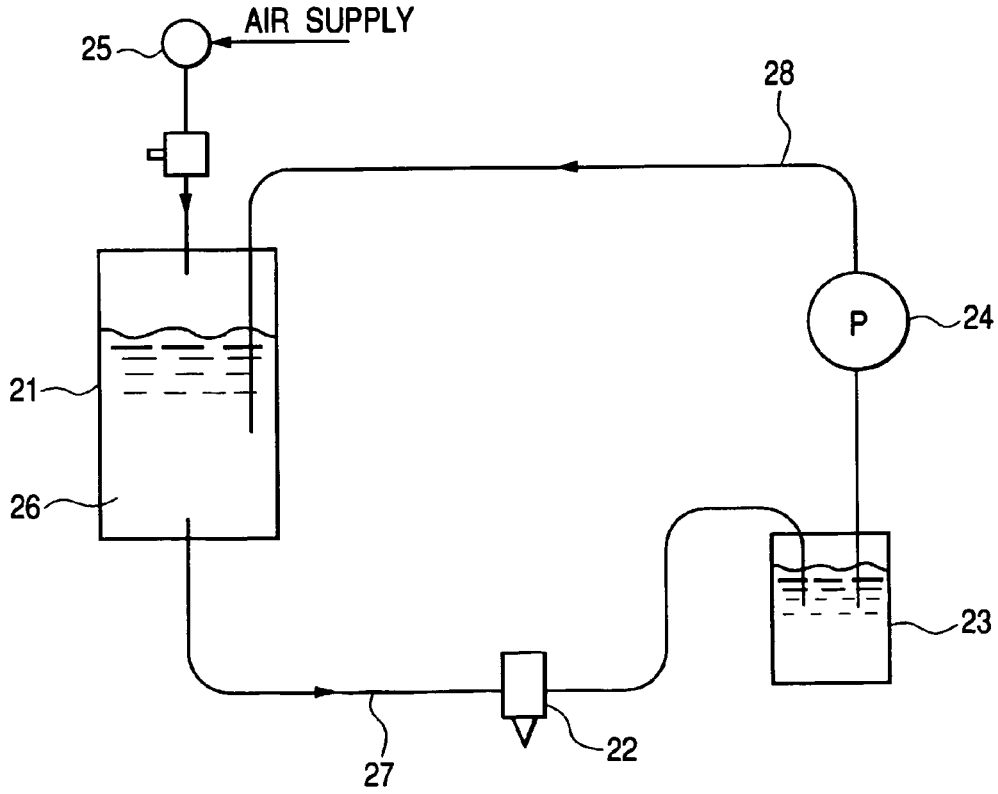
FIG. 2 is a system diagram showing a liquid dispensing apparatus according to another embodiment of the present invention.

FIG. 2 shows a liquid dispensing method and apparatus according to the liquid moving method according to another embodiment of the present invention.

A liquid 26 pressurized and filled in a vessel 21 is pumped to a vessel 23 through an auto-dispensing valve 22 connected to a pipe 27 as a flow passage while its flow rate is regulated by flow rate regulating means such as an unshown orifice. The liquid accumulated in the vessel 23 is pumped to the vessel 21 through a pipe 28 by an inexpensive pump 24 at a higher liquid pressure to be circulated. The pump 24 is a commercially available inexpensive pump such as a diaphragm pump or tube pump which can maintain pressure applied to the liquid in the vessel 21 at a fixed level by using a regulator with relief 25 for compressed gas or the like even when there are irregular pulses or the level of the liquid in the vessel 21 rises. In addition, the pipe 28 for connecting the pump 24 and the vessel 21 may be provided with a check valve therebetween if necessary. Even when this method for moving the liquid is employed, the liquid having high quality and uniform dispersibility of particles is dispensed by the auto dispensing valve 22 for a desired period of time, thereby making it possible to perform smooth continuous operation.

Figure 3:
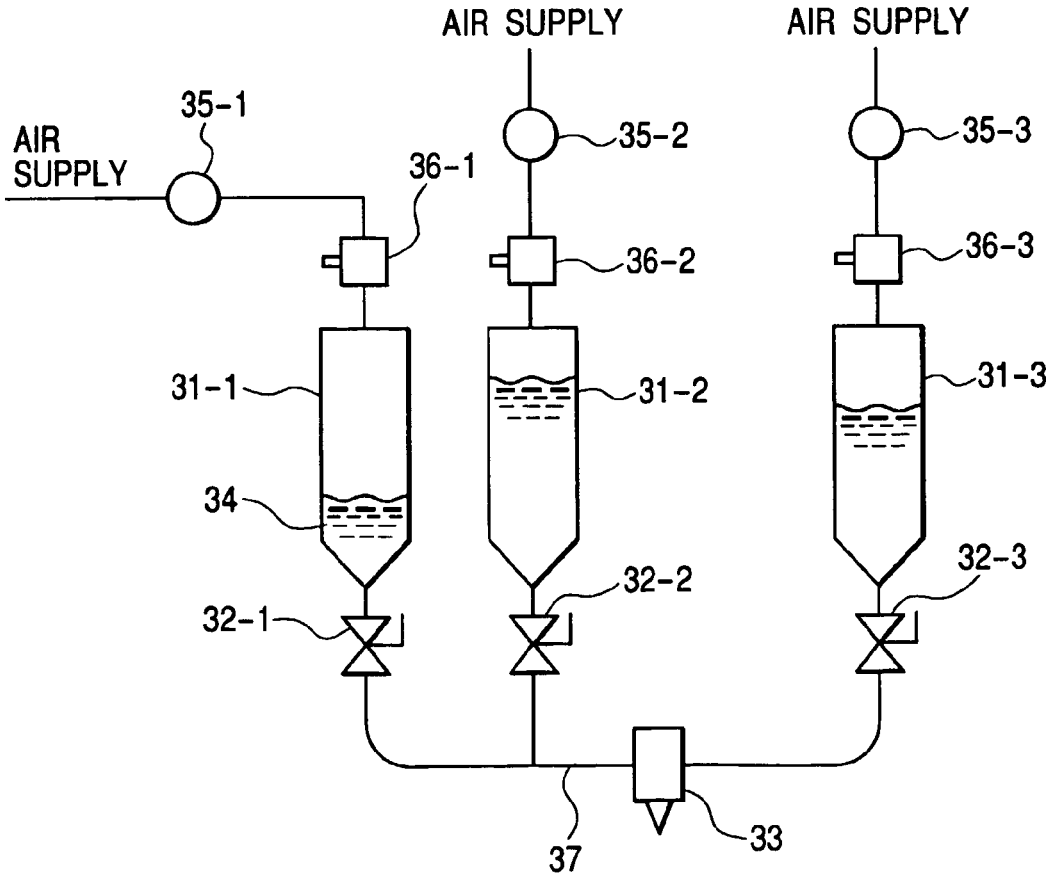
FIG. 3 is a system diagram of a liquid dispensing apparatus having three vessels according to still another embodiment of the present invention.
Figure 4:
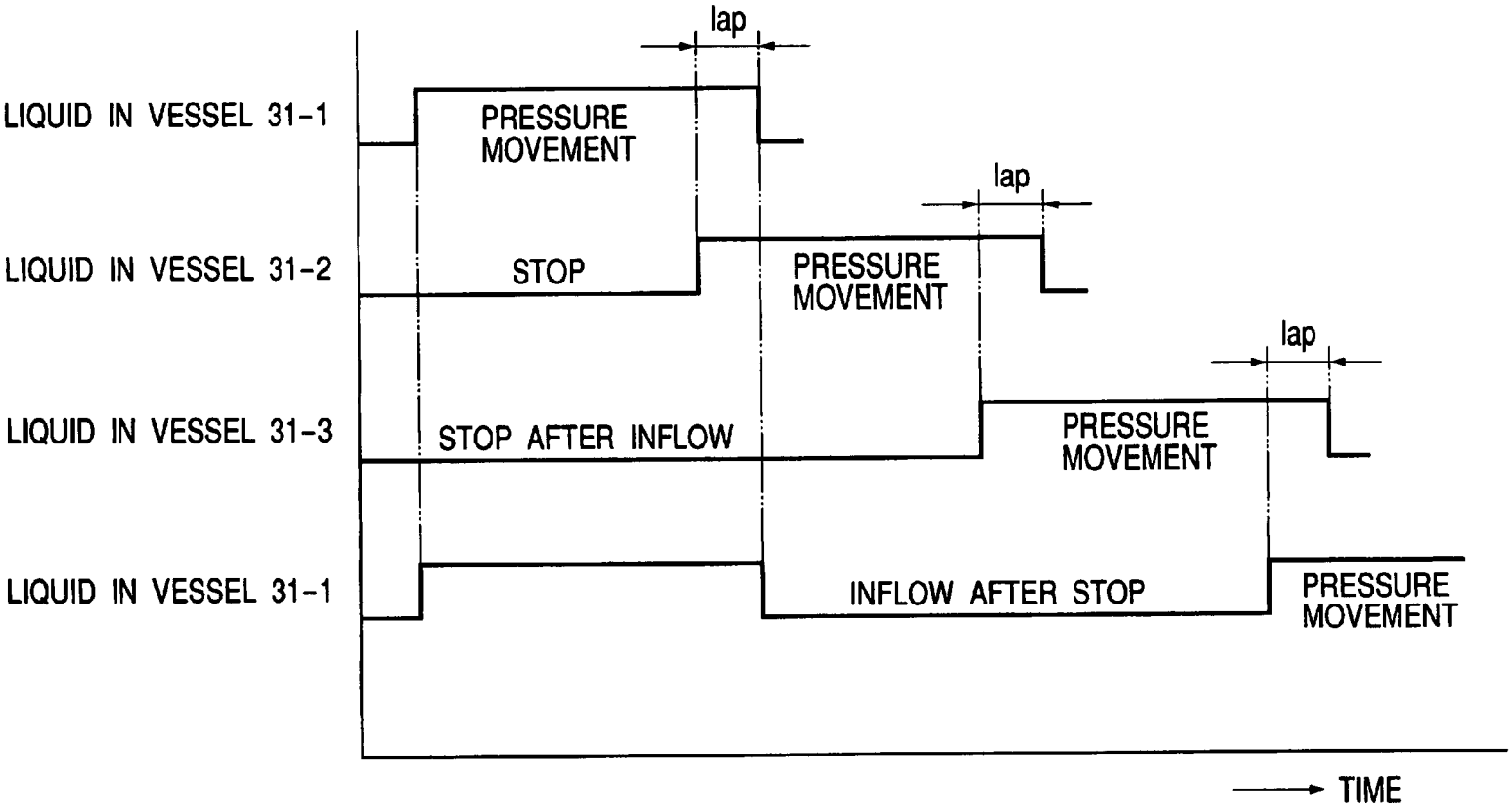
FIG. 4 is a time chart showing three vessels of the liquid dispensing apparatus shown in FIG. 3 illustrating in time series the relationship among liquid flows from the respective vessels.

FIG. 3 and FIG. 4 show a liquid dispensing method and apparatus according to still another embodiment of the present invention. FIG. 3 is a system diagram of a liquid dispensing apparatus having three vessels and FIG. 4 is a time chart showing the three vessels of the liquid dispensing apparatus shown in FIG. 3 illustrating in time series the relationship among flows of the liquid from the respective vessels.

An air regulator 35-1 for supplying a compressed gas is connected to a vessel 31-1 through a three-way solenoid valve 36-1. The solenoid valve 36-1 is in an open state by an instruction from an unshown controller incorporated with a program and installed separately. A liquid 34 in the vessel 31-1 is pressurized by the pressure of a compressed gas whose pressure has been adjusted by the regulator set to a desired pressure to flow into a flow passage 37 and passes through an on-off valve with an orifice 32-1 which is at an open position by an instruction from the controller and further through an auto dispensing valve 33 and an on-off valve with an orifice 32-3 which is in an open state and connected to a vessel 31-3, to move into the vessel 31-3. The vessel 31-3 is connected to an air regulator 35-3 for adjusting the pressure of a compressed gas through a three-way solenoid valve 36-3 which has already been instructed to be closed and is at a position where the inside of the vessel 31-3 communicates with an air opening port.

Further, a liquid accumulated in a vessel 31-2 does not move because an on-off valve 32-2 instructed to be closed but pressurized with a compressed gas because a solenoid valve 36-2 connected to the vessel 31-2 is instructed to be opened. When the liquid in the vessel 31-1 reaches a lower limit, an unshown liquid level sensor or the like detects this and an opening instruction is given from the controller to the on-off valve 32-2 connected to the vessel 31-2 so as to start moving the liquid in the vessel 31-2 to the vessel 31-3. For example, the on-off valve 32-1 which receives an instruction from the controller after 20 milliseconds is closed and the solenoid valve 36-1 is also instructed to be closed at the same time, so that the air opening port of the solenoid valve 36-1 is connected to the inside of the valve 31-1 to reduce the inside pressure of the valve 31-1 to atmospheric pressure.

When the liquid level of the vessel 31-3 reaches an upper limit, the on-off valve 32-1 of the vessel 31-1 is opened upon detection by a level sensor or the like connected to the controller to make the liquid also flow in the vessel 31-2 toward the vessel 31-1. At the same time, the on-off valve 32-3 connected to the vessel 31-3 is closed and the solenoid valve 36-3 is opened for standby for the next switching.

This operation is performed periodically and the liquid can be dispensed at a desired timing during this operation. That is, during the above-mentioned operation, the liquid including solid particles flowing through the flow passage 37 is dispensed by the liquid dispensing valve 33 having the same constitution as shown in FIG. 1. Since the liquid is pumped in the flow passage 37 at this point, the precipitation of the solid particles is prevented and the flow rate of the liquid is adjusted by the function of the orifices of the on-off valves with an orifice 32-1, 32-2 and 32-3 so as to make the liquid flow in the flow passage at a predetermined rate. As a result, the liquid having high quality and uniform dispersibility of the particles is dispensed by the auto-dispensing valve 1 for a desired period of time so that smooth continuous operation is carried out.

Further, in the above-mentioned embodiments, the amount of the liquid equal to the dispensed amount can, always or regularly, be automatically supplied into a vessel or connection circuit by a liquid feeder. Further, in the present invention, the liquid is moved without stopping the pressurization of the liquid by pre-programming the controller based on one dispensation without using a level sensor or the like, thereby making it possible to dispense the liquid including solid particles without precipitating the solid particles and automatically replenish the liquid.

In the above-mentioned embodiments, the number of vessels filled with the liquid is 2 or 3. However, in the present invention, four or more vessels may be provided to carry out a desired combination of inflow and outflow systems of the liquid through flow passages connecting these vessels in order to dispense the liquid from the flow passages through the liquid dispensing valve.

As obvious from the above description, according to the present invention, there can be obtained a method and apparatus for dispensing a liquid, which make it possible to handle a minimum amount of the liquid without wasting it and to dispense or spray an exact amount of the liquid without precipitating the solid particles. That is, since the liquid including solid particles is pumped through a flow passage, the precipitation of the solid particles is prevented and the flow rate of the liquid is regulated by the function of flow rate regulating means to make the liquid flow through the flow passage at a predetermined rate. As a result, the liquid having high quality and uniform dispersibility of particles is dispensed by a liquid dispensing valve for a desired period of time, so that smooth continuous operation can be carried out. Therefore, the invention is particularly useful when the vessel is a small-sized vessel and an expensive liquid is filled in the vessel to be dispensed from the vessel, because a minimum and exact amount of the liquid can be dispensed without wasting it.

The invention claimed is:

1. A liquid dispensing apparatus comprising:

a first vessel configured to be filled with a liquid;

a second vessel configured to be filled with the liquid;

a flow passage connecting said first and second vessels, the flow passage constructed and arranged to enable the liquid to flow between the first and second vessels;

a valve coupled with the flow passage, the valve configured for dispensing the liquid from the flow passage;

a first pressurizing device configured to apply a first pressure to the liquid in the first vessel;

a second pressurizing device configured to set a second pressure of the liquid in the second vessel; and a first flow rate restricting member disposed in the flow passage; and a second flow rate restricting member disposed in the flow passage;

wherein the first and second flow rate restricting member are configured to regulate a flow rate of the liquid flowing in the flow passage between the first and second vessels when the first and second pressuring devices are operated such that the first pressure applied to the liquid in the first vessel differs from the second pressure applied to the liquid in the second vessel.

2. The apparatus of claim 1 wherein the first and second pressurizing devices each use compressed gas to apply the first and second pressures.

3. The apparatus of claim 2 wherein the compressed gas is applied using a plunger provided between the compressed gas and the liquid.

4. The apparatus of claim 1 wherein the valve includes a spray nozzle.

5. The apparatus of claim 4 wherein the spray nozzle atomizes the liquid using a gas.

6. The apparatus of claim 1 wherein the first flow restricting member includes an orifice.

7. The apparatus of claim 6 wherein the second flow restricting member includes an orifice.

8. The apparatus of claim 1 wherein the first and second vessels are syringes.

9. The apparatus of claim 1 wherein the first flow restricting member is disposed in the flow passage between the valve and the first vessel.

10. The apparatus of claim 1 wherein the second flow restricting member is disposed between the valve and the second vessel.

* * * * *

UNITED STATES PATENT AND TRADEMARK OFFICE

CERTIFICATE OF CORRECTION

PATENT NO. : 7,387,681 B2
APPLICATION NO. : 10/509344
DATED : June 17, 2008
INVENTOR(S) : Masafumi Matsunaga et al.

It is certified that error appears in the above-identified patent and that said Letters Patent is hereby corrected as shown below:

Column 4, line 13, change “its-” to --its--.

Column 10, line 9, Claim 1, change “member” to --members--.

Signed and Sealed this

Sixth Day of October, 2009

David J. Kappos

David J. Kappos
*Director of the United States Patent and Trademark Office*